United States Patent [19]

Fontana

[11] Patent Number: 4,813,611

[45] Date of Patent: Mar. 21, 1989

[54] COMPRESSED AIR NOZZLE

[76] Inventor: Frank Fontana, 22 Spruce Rd., Briarcliff Manor, N.Y. 10510

[21] Appl. No.: 132,963

[22] Filed: Dec. 15, 1987

[51] Int. Cl.[4] ..... E21B 11/00

[52] U.S. Cl. ..... 239/589; 239/590.5; 175/424

[58] Field of Search ..... 239/589, 590, 590.5; 175/393, 424

[56] References Cited

U.S. PATENT DOCUMENTS 4,134,547 1/1979 Gamst ..... 239/589

4,300,723 11/1981 Prasthofer ..... 239/589

FOREIGN PATENT DOCUMENTS 2521253 11/1976 Fed. Rep. of Germany ..... 239/590

*Primary Examiner*—Andres Kashnikow

*Assistant Examiner*—Karen B. Merritt

*Attorney, Agent, or Firm*—Brooks Haidt Haffner & DeLahunty

[57] ABSTRACT

A compressed air nozzle for accelerating the flow of air from a compressor to supersonic speed has an axial passage which comprises a converging portion and a diverging portion interconnected by an elongated throat. The nozzle is useful in tools for dislodging earth for excavation.

10 Claims, 1 Drawing Sheet

COMPRESSED AIR NOZZLE

BACKGROUND OF THE INVENTION

1. Field of the Invention

This invention relates to a nozzle for accelerating the rate of flow of compressed air to supersonic speed.

2. Description of the Prior Art

Tools for delivering a high speed flow of air for cleaning and excavating are known.

For example, a tool known as the Supersonic Air Knife is available from Briggs Technology Inc. for use in manual excavation tasks such as exposing gas mains by breaking apart and pushing out soil.

U.S. Pat. No. 4,360,949 to Wilson shows a pneumatic cleaning device which uses air under pressure and Bonnevalle U.S. Pat. No. 3,511,326 shows a device for injecting a mixture of air and water under pressure for restoring clogged wells.

A converging-diverging venturi nozzle using high-pressure water is shown in U.S. Pat. No. 3,620,457 to Pearson and a nozzle for discharging drilling fluid in a drill bit is shown in Sorenson U.S. Pat. No. 4,603,750.

However, no prior art compressed air nozzle has been totally satisfactory for manual excavation to uncover buried pipes, electrical cables and the like. The present invention relates to a compressed air nozzle which is useful in such excavating tasks.

SUMMARY OF THE INVENTION

Utility companies and others are often required to obtain access to gas pipes, electrical cables and the like, which are buried in the earth, sometimes in locations where space is restricted by existing construction. The use of traditional tools such as shovels and picks for such work is not only demanding on workers, but is very time consuming and may be dangerous. Such tools can, for example, strike a live electrical cable.

Recently, tools have been developed which use a stream of high pressure air to break up and dislodge soil. However, such devices have the drawback of blowing particles forcibly away from the air jet, which requires the operator to wear protective goggles or other safety gear.

What is desired is a "civilized" tool for using a stream of air under pressure at supersonic speed for excavation. The nozzle of the present invention overcomes the drawbacks of previous compressed air excavating tools.

This will be more fully understood when the following detailed description is read in view of the accompanying drawings which illustrate a preferred embodiment of the invention.

DETAILED DESCRIPTION OF A PREFERRED EMBODIMENT

Figure 1:
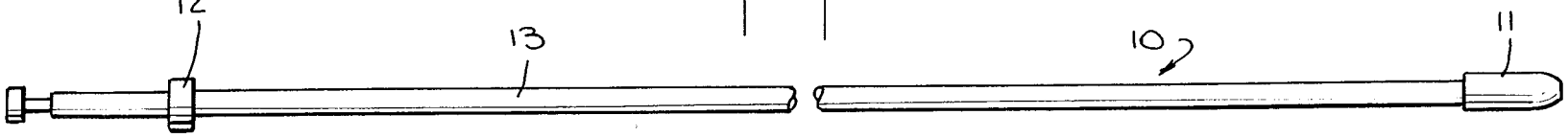
FIG. 1 shows a typical tool equipped with the compressed air nozzle of the invention.

FIG. 1 shows a tool generally designated by the reference numeral 10 equipped with a nozzle 11 according to the invention. In a typical application the tool 10 would be supplied with compressed air from a compressor (not shown) at a pressure of about 100 pounds per square inch (psi) and at a flow rate of about 125 to 160 cubic feet per minute (cfm). An operator can control the supply of air to the tool 10 by means of a conventional valve such as the squeeze valve 12 which is somewhat schematically shown in FIG. 1, which shuts off the supply of air to the tool 10 when not squeezed by the tool operator, in effect operating as a "dead man switch".

The tool 10 has a tube 13, dimensioned to provide for ease of operation by the user. A five or six-foot length of plain pipe, for example, nominally one inch diameter steel pipe having a threaded end where the nozzle 11 is connected to the tube 13 will allow an operator to stand upright in the performance of most excavating tasks.

In operation of the tool 10 the operator moves the nozzle 11 in an up and down fashion to loosen and break up the earth at the desired location, without damaging effects to the immediate environment. The jet of compressed air exiting the nozzle is of sufficient force to achieve its desired purpose, but does not damage a solid object such as a pipe or wire with which it comes into contact, and will not endanger the foot of a worker wearing suitable boots or shoes.

It has been mentioned that the ordinary compressor delivers about 125 to 160 cfm. The nozzle 11 of the present invention, illustrated in greater detail in FIG. 2 increases the velocity of air flow to a supersonic speed of about 1500 feet per second, which is sufficient to shake loose the soil at the chosen location without impelling fragments or particles out at high speeds, since such flying particles could be hazardous.

The loosened or displaced earth can then be removed by means of a vacuum excavating device of known construction.

The nozzle is designed so that the jet or supersonic air decays in velocity after travelling about $\frac{3}{4}$ inch from the nozzle. This provides for effective excavating operation without excessive expulsion of loosened particles. A presently preferred embodiment of the nozzle 11 is shown in longitudinal cross section in FIG. 2.

The nozzle 11 is preferably of one-piece construction. It is preferably of hard metal such as stainless steel, but could be of some other rigid material. In the illustrated embodiment the nozzle has internal threads at 14 for connection to external threads on a pipe such as the pipe 13.

Figure 2:
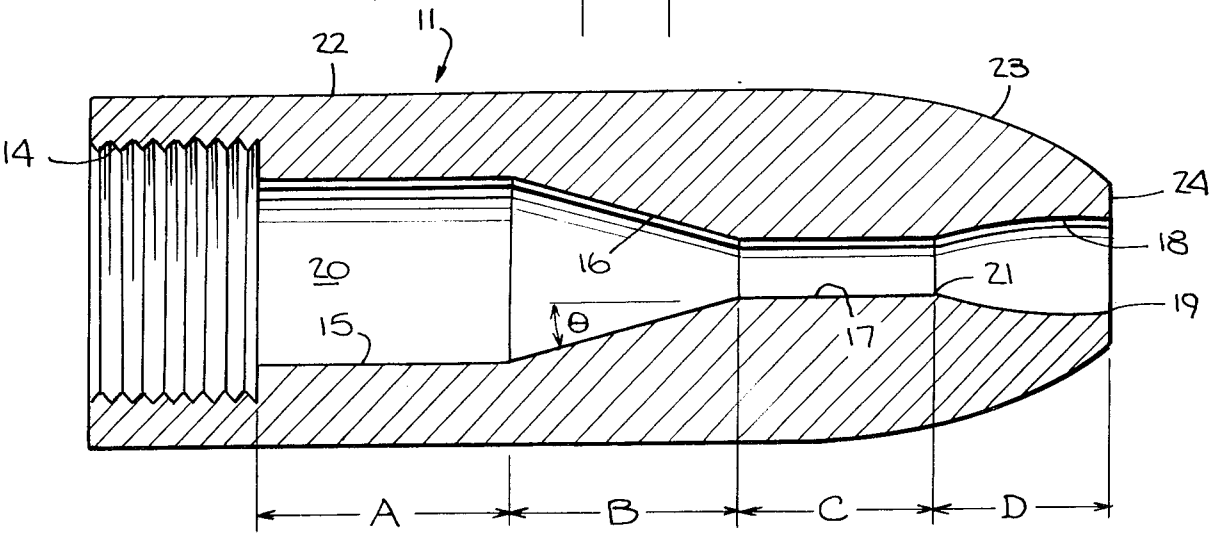
FIG. 2 is a view in section of a nozzle according to the invention.

The nozzle 11, as shown in FIG. 2, has a central axial passage comprising a cylindrical entrance portion surrounded by a wall 15, a converging portion surrounded by a frusto-conical wall 16, an elongated cylindrical throat surrounded by a wall 17 and a diverging portion surrounded by a wall 18 which curves smoothly in the direction of the mouth 19 of the nozzle. It is this configuration which provides for acceleration of the flow of compressed air to supersonic speed about twice the velocity at which the air enters the nozzle at the area 20. All portions of the passage are volumes of revolution about a common axial centerline as shown.

It has been found that superior performance can be achieved when the wall 16 of the converging portion slants toward the cenerline at an angle $\theta$ of about 14 to 15 degrees. In other words, the cone of which the converging wall 10 is a frustum would have an apex angle of about 30°.

The wall 18 of the diverging portion of the passage curves smoothly to promote smooth flow of the existing air, and an angle constructed between the entrance to the diverging portion at 21 and the exit at 19 is, as shown, considerably smaller than the angle $\theta$. This is most readily apparent from a comparison of the diameter defined by the cylindrical wall 15 and the exit aperture at 19 taking into account the fact that the diverging portion defined by the wall 18 is of shorter length than the converging portion defined by wall 16.

It is believed that the presence of the elongated throat defined by the wall 17 between the converging and diverging portion of the passage accounts for the superior performance of the nozzle 11, as compared to a simple venturi tube design, which has no such elongated throat.

Tests have shown that when the nozzle passage dimensions are in a certain relationship, the nozzle is very effective in achieving its purpose. The length A of the cylindrical portion and the length B of the converging portion are similar to each other and each is greater than the length C of the throat and the length D of the diverging portion, the latter two lengths being similar to each other.

In one particularly preferred embodiment the cylindrical portion defined by the wall 15 has a diameter of 0.75 inch; the cylindrical throat defined by wall 17 has a diameter of 0.25 inch; and the circular exit aperture 19 has a diameter of 0.375 inch. In that embodiment the length A is 1.0 inch; length B is also 1.0 inch; and the lengths C and D are each 0.75 inch.

When compressed air at 100 pounds per square inch pressure is fed to the nozzle just described at a rate of 125 cubic feet per minute and at a temperature of 70° F., it will exit the nozzle, assuming isentropic flow, at a velocity of about 1680 feet per second. In practice, the velocity of the exiting air has been found to be about 1500 feet per second.

The nozzle has a generally cylindrical body 22 with its forward portion curving inward at 23 to terminate in a flat face 24 of annular shape. The avoidance of sharp edges or corners promotes safe and easy use of a tool 10 equipped with the nozzle 11.

Various modifications and applications of the nozzle described and shown will suggest themselves to those acquainted with the art, and accordingly are considered to be within the spirit and scope of the invention.

What is claimed is:

1. A compressed air nozzle for accelerating a flow of air to supersonic speed comprising means defining a passage which is circular in cross section throughout the length of the passage, said passage having a converging entrance portion, a diverging discharge portion having a terminal end discharging to atmosphere, and an elongated generally cylindrical throat interconnecting said entrance and discharge portions, said diverging portion and said throat being substantially equal to each other in length and substantially shorter than the length of said converging portion.

2. The compressed air nozzle of claim 1 wherein the converging portion has the shape of a frustum of a right circular cone having an interior apex angle of about 30°, and the diverging portion has an encircling wall which curves smoothly in the axial direction of the passage, said length of the diverging portion and the throat each being substantially equal to three-quarters ($\frac{3}{4}$) of said length of the converging portion.

3. The compressed air nozzle of claim 1 wherein said throat has a length equal to substantially three times the throat diameter.

4. The compressed air nozzle of claim 1 wherein the greatest diameter of said converging portion exceeds the greatest diameter of said diverging portion.

5. The compressed air nozzle of claim 1 wherein the greatest diameter of said diverging portions is substantially equal to one-half ($\frac{1}{2}$) of the greatest diameter of said converging portion.

6. The compressed air nozzle of claim 1 wherein the converging portion has the shape of a frustum of a right circular cone which has a wall forming an angle of about 14 to 15 degrees with a centerline of said cone.

7. The compressed air nozzle of claim 1 wherein each of said converging portion, said diverging portion and said throat has a length which is greater than its greatest diameter.

8. A soil excavating tool for utilizing compressed air to loosen the soil to be excavated, comprising a manually maneuverable, elongated and rigid air pipe having an air inlet end and an exit end, and a compressed air nozzle having an air discharge end terminus and being attached at its opposite end to said pipe exit end for accelerating said air to supersonic velocity over a short distance extending away from its said discharge end terminus, said nozzle comprising means defining an air passage there through which is circular in cross section throughout the length of the passage, said passage having a converging entrance portion adjacent to said nozzle opposite end, a diverging discharge portion having a terminal end which defines said discharge end terminus of the nozzle, and an elongated generally cylindrical throat interconnecting said converging entrance and diverging discharge portions, said diverging portion and said throat having substantially the same length which is substantially shorter than the length of said converging portion, the respective lengths of said portions each being greater than their respective greatest diameters, the diameter of said throat being substantially equal to one-third ($\frac{1}{3}$) of its said length, said converging portion having the shape of a frustum of a right circular cone whose interior apex angle is about 30° and whose greatest diameter is substantially equal to the interior diameter of said airpipe, and said diameter of said diverging portion at its said terminal end being substantially equal to one-half ($\frac{1}{2}$) the diameter of said greatest diameter of the converging portion and also substantially equal to one and one-half ($1\frac{1}{2}$) times said diameter of said throat.

9. A soil excavating tool according to claim 8, wherein said diverging portion has an encircling wall which curves smoothly in the axial direction of said passage.

10. A soil excavating tool according to claim 9, wherein said nozzle has an exterior surface including a generally cylindrical body portion having an inwardly curving portion towards its said air discharge end terminus and terminating in a flat annular face at said end terminus.

* * * * *